US005870270A

United States Patent [19]

Riley et al.

[11] Patent Number: 5,870,270

[45] Date of Patent: Feb. 9, 1999

[54] NON-BURNOUT CONTROLLER FOR A SWITCHING COIL

[75] Inventors: H. Lee Riley, Middletown, Del.; Kwok-Wah Leung, Kowloon, Hong Kong

[73] Assignee: Bachmann Industries, Inc., Philadelphia, Pa.

[21] Appl. No.: 2,411

[22] Filed: Jan. 2, 1998

Related U.S. Application Data

[60] Provisional application No. 60/061,745, Oct. 13, 1997.

[51] Int. Cl. [6] ..... H01H 47/00

[52] U.S. Cl. ..... 361/152; 361/154; 361/160; 361/143; 361/194

[58] Field of Search ..... 335/78, 117; 361/143, 361/147, 152–154, 160, 166, 167, 189, 191, 194, 195, 210

[56] References Cited

U.S. PATENT DOCUMENTS

| | | | |
|---|---|---|---|
| 1,891,059 | 12/1932 | Rosenthal . | |
| 3,579,041 | 5/1971 | Paine et al. . | |
| 3,590,334 | 6/1971 | Baker | 361/154 |
| 4,034,168 | 7/1977 | Brown . | |
| 4,185,561 | 1/1980 | Reymann . | |
| 4,223,857 | 9/1980 | Hussein . | |
| 4,257,081 | 3/1981 | Sauer et al. | 361/156 |
| 4,335,381 | 6/1982 | Palmer . | |
| 4,497,011 | 1/1985 | Hurtig | 361/147 |
| 4,527,216 | 7/1985 | Stammely | 361/156 |
| 4,577,658 | 3/1986 | Bosteels et al. | 137/599 |
| 4,630,166 | 12/1986 | D'Onofrio . | |
| 4,718,454 | 1/1988 | Appleby | 137/624.11 |
| 4,777,556 | 10/1988 | Imran | 361/155 |
| 5,206,782 | 4/1993 | Landmeier et al. . | |
| 5,451,017 | 9/1995 | Graff et al. . | |
| 5,554,961 | 9/1996 | McCulloch | 335/78 |
| 5,579,293 | 11/1996 | Ishii | 369/13 |
| 5,583,422 | 12/1996 | Schirmer et al. . | |

*Primary Examiner*—Jeffrey Gaffin
*Assistant Examiner*—Kim N. Huynh
*Attorney, Agent, or Firm*—Panitch Schwarze Jacobs & Nadel, P.C.

[57] ABSTRACT

A non-burnout controller for a switching coil is disclosed. The controller has a pulse timer, a relay switch, and an actuation switch. After being reset and actuated, the pulse timer defines a pulse having a predetermined pulse period. The relay switch has a switch actuation input for receiving the pulse and first and second switch outputs for being electrically coupled to first and second taps of the switching coil. The relay switch places a switching voltage across the outputs during the pulse period such that the switching coil has a switching current running therethrough. The relay switch places a substantially zero voltage across the outputs before and after the pulse period such that the switching coil has substantially no switching current running therethrough. The actuation switch has first and second positions. Upon being changed to the first position, the actuation switch resets the timer, whereby the switching coil has substantially no current running therethrough. Upon being changed to the second position, the actuation switch actuates the timer to define the pulse and issues the pulse to the switch actuation input of the relay switch, whereby during the pulse period the switching coil has the switching current running therethrough, and after the pulse period the switching coil has substantially no current running therethrough. The predetermined period od the pulse prevents switching coil burnout.

12 Claims, 3 Drawing Sheets

NON-BURNOUT CONTROLLER FOR A SWITCHING COIL

CROSS-REFERENCE TO RELATED APPLICATIONS

This application claims the benefit of U.S. Provisional Application No. 60/061,745, filed Oct. 13, 1997 and incorporated herein by reference.

FIELD OF THE INVENTION

The present invention relates to a controller for a switching coil wherein the controller prevents coil burnout. More particularly, the present invention relates to such a controller wherein the controller issues a switching pulse having a predetermined pulse period to the switching coil.

BACKGROUND OF THE INVENTION

As is known, a switching coil may be employed in a wide variety of applications to electrically actuate a mechanical switch movable between two positions. Typically, the switching coil has at least two taps, and current is run through the coil to generate magnetic flux in one direction. The generated magnetic flux moves a magnet associated with the switching coil, and the magnet is connected to the mechanical switch such that the movement of the magnet actuates the mechanical switch. Of course, the magnet may be moved in the opposite directions by running current through the coil to generate magnetic flux in the opposite direction. As is known, to generate such magnetic flux in opposite directions in a two-tap coil, the polarity of the current may be reversed. Similarly, in a three-tap coil, current may be run from a center tap to either one of two end taps or from either end tap to the center tap.

One known use for such a switching coil is in a track switch of a model railroad set. In such a situation, the track switch is for example operated by an electrical switch with a mechanical sliding contact, where the contact is moved to a pre-determined position and then pushed down to complete an electrical circuit that applies current to the switching coil. As should be understood, the electrical circuit need only be completed for a relatively short period of time in order to actuate the switching coil, move the permanent magnet, and thereby operate the track switch. However, it is often the case that an operator of the aforementioned electrical switch will complete the circuit for a relatively long period of time, with the result that the switching coil current generates excessive heat and physically burns out the switching coil.

Accordingly, a need exists for a controller that, upon being actuated, pulses the switching coil for a relatively short period of time that is not so long as to burn out the switching coil.

BRIEF SUMMARY OF THE INVENTION

The aforementioned need is satisfied by a non-burnout controller for a switching coil having first and second taps. The controller has an actuatable resetable pulse timer, a relay switch, and an actuation switch. The pulse timer is reset and defines a pulse after being reset and actuated. The pulse has a predetermined pulse period.

The relay switch has a switch actuation input for receiving the pulse and first and second switch outputs for being electrically coupled to the first and second taps of the switching coil. The relay switch places a switching voltage across the first and second switch outputs during the pulse period such that the switching coil has a switching current running therethrough. The relay switch places a substantially zero non-switching voltage across the first and second switch outputs before and after the pulse period such that the switching coil has substantially no switching current running therethrough.

The actuation switch is positionable in first and second positions. Upon being changed to the first position, the actuation switch resets the timer, whereby the switching coil has substantially no current running therethrough. Upon being changed to the second position, the actuation switch actuates the timer to define the pulse and issues the pulse to the switch actuation input of the relay switch, whereby during the pulse period the switching coil has the switching current running therethrough, and after the pulse period the switching coil has substantially no current running therethrough. The predetermined length of the pulse period prevents switching coil burnout.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
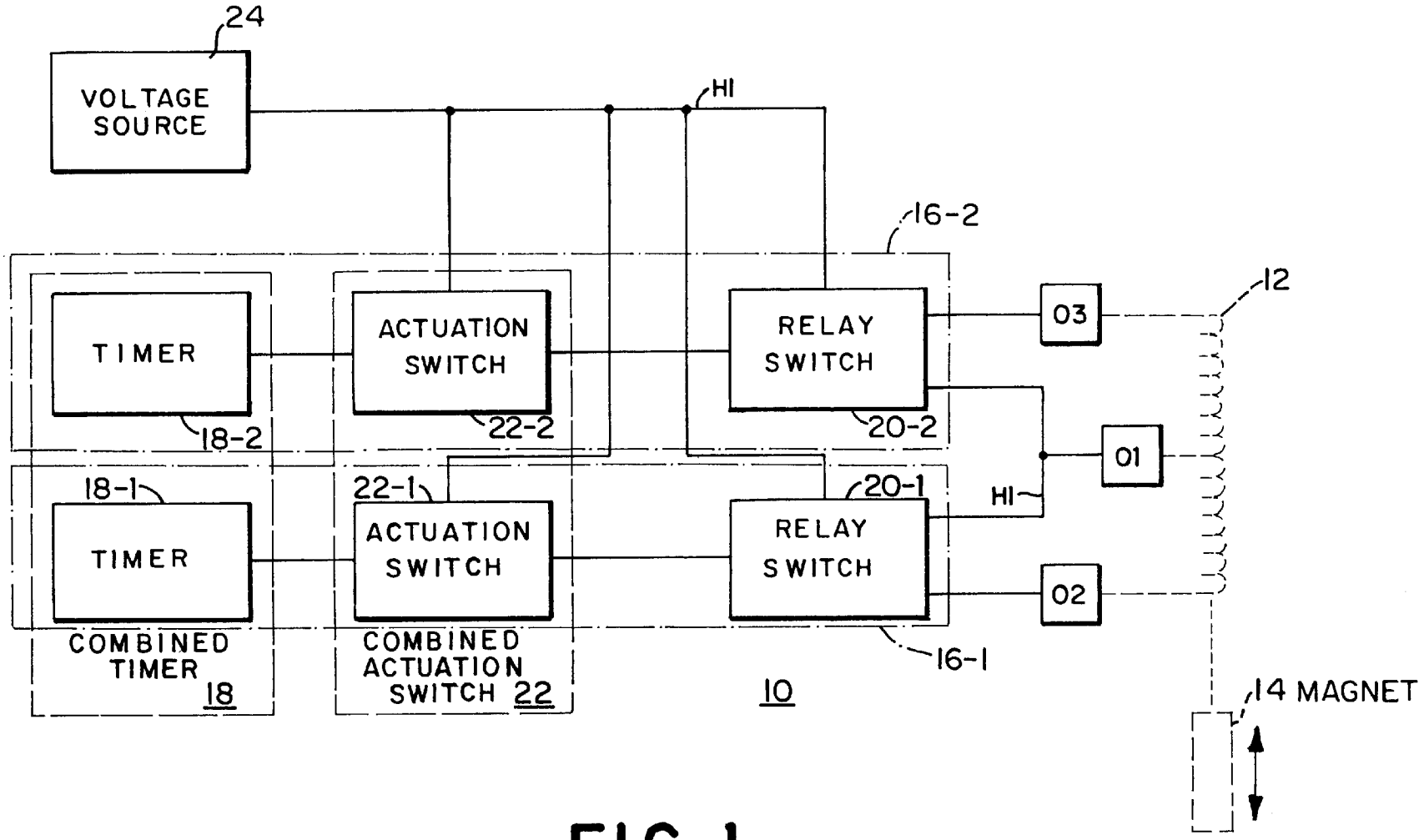
FIG. 1 is a block diagram of the non-burnout controller in accordance with a preferred embodiment of the present invention.

Certain terminology may be used in the following description for convenience only and is not limiting. "Left", "right", "upper", and "lower" designate directions in the drawings to which a reference is made. The words "inwardly" and "outwardly" are further directions toward and from, respectively, the geometric center of a referenced object. The terminology includes the words above specifically mentioned, derivatives thereof, and words of similar import.

Referring to the drawings in detail, wherein like numerals are used to indicate like elements throughout, there is shown in FIG. 1 a block diagram of a non-burnout controller 10 in accordance with a preferred embodiment of the present invention. As seen, the controller 10 is for a switching coil 12. The coil has a first tap connected to a first output O1 and a second tap connected to an output O2, and also has a switching magnet 14 associated therewith such that the switching coil 12 actuates a mechanical switch by way of the switching magnet 14.

As seen in FIG. 1, the controller comprises a switch circuit 16-1 having an actuatable resettle pulse timer 18-1, a relay switch 20-1, and an actuation switch 22-1. The timer 18-1 is for defining a pulse after being reset and actuated, where the pulse has a predetermined pulse period. The timer 18 maybe any appropriate timer without departing from the spirit and scope of the present invention.

The relay switch 20-1 has a switch actuation input for receiving the pulse from the timer 18 (by way of the actuation switch 22-1), and first and second switch outputs (i.e., the first and second outputs O1, O2) that are electrically coupled to the first and second taps of the switching coil 12. In operation, the relay switch 20-1 places a switching voltage across the first and second outputs O1, O2 during the pulse period such that the switching coil 12 has a switching current running therethrough. Before and after the pulse period, the relay switch 20-1 places a substantially zero non-switching voltage across the first and second outputs O1, O2 such that the switching coil 12 has substantially no switching current running therethrough.

The actuation switch 22-1 is positionable in first and second positions. Upon being changed to the first position, the actuation switch 22-1 resets the timer 18-1, whereby the switching coil has substantially no current running therethrough. Upon being changed to the second position, the actuation switch 22-1 actuates the timer 18-1 to define the pulse and issues the pulse to the switch actuation input of the relay switch, whereby during the pulse period the switching coil 12 has the switching current running therethrough, and after the pulse period the switching coil 12 has substantially no current running therethrough.

The predetermined length of the pulse period as defined by the timer 18-1 is set to prevent switching coil burnout. Such length will vary based on the particular switching coil 12, and may for example be 0.1 to 0.2 seconds for a relatively small switching coil 12 and 2 or 3 seconds for a relatively large coil 12.

Preferably, and as seen in FIG. 1, the controller 10 includes or is coupled to a voltage source 24 that provides a substantially constant source voltage (HI) to at least the relay switch 20-1. Accordingly, the first output O1 is preferably electrically coupled to the source voltage at all times, the second output O2 has a substantially zero voltage during the pulse period, and the second output O2 has substantially the source voltage before and after the pulse period. Alternatively, the second output O2 is substantially short circuited to a ground during the pulse period, and is substantially open circuited to the ground before and after the pulse period. In either case, the result is that switching current runs through the switching coil 12 from the first output O1 (HI) to the second output O2 (0) during the pulse period, and no switching current runs through the switching coil 12 from the first output O1 (HI) to the second output O2 (HI) before and after the pulse period.

As thus far described, the controller 10 as shown in FIG. 1 can apply switching current in one direction and thus move the magnet 14 from a first position to a second position. However, since no provision is made for reversing the switching current between the first and second outputs O1, O2, the magnet 14 cannot be moved back to the first position absent some externally applied switching force. Accordingly, it is preferable that the first tap of the switching coil 12 is a center tap, the second tap of the switching coil 12 is a first end tap, and the switching coil 12 further comprises a third tap which is a second end tap, and it is likewise preferable that the controller comprise first and second ones of the switching circuits 16-1, 16-2 to move the switching magnet back and forth between the first and second positions. As should be understood, switching circuit 16-2 is substantially identical to switching circuit 16-1 except insofar as is necessary to produce opposing switching currents in the switching coil 12.

Accordingly, and as seen, it is preferable that the first and second outputs O1, O2 of the relay switch 20-1 of the first switching circuit 16-1 are electrically coupled to the first and second taps of the switching coil, respectively, and that the first and second switch outputs O3, O2 of the relay switch 20-2 of the second switching circuit 16-2 for being electrically coupled to the first and third taps of the switching coil, respectively.

Moreover, since the switching circuits 16-1, 16-2 are operated in tandem, it is preferable that the actuation switch 22-1 of the first switching circuit 16-1 and the actuation switch 22-2 of the second switching circuit 16-2 comprise a combined actuation switch 22 positionable in A and B positions. Accordingly, it is preferable that combined actuation switch 22 in the A position corresponds to the actuation switch 22-1 of the first switching circuit 16-1 being in the first position and the actuation switch 22-2 of the second switching circuit 16-2 being in the second position; and that the combined actuation switch 22 in the B position corresponds to the actuation switch 22-1 of the first switching circuit 16-1 being in the second position and the actuation switch 22-2 of the second switching circuit 16-2 being in the first position. As should be understood then, when moved to the A position, the combined actuation switch 22 resets the timer 18-1 of the first switching circuit 16-1 and actuates the timer 18-2 of the second switching circuit 16-2. Likewise, when moved to the B position, the combined actuation switch 22 resets the timer 18-2 of the second switching circuit 16-2 and actuates the timer 18-1 of the first switching circuit 16-1.

Figure 2:
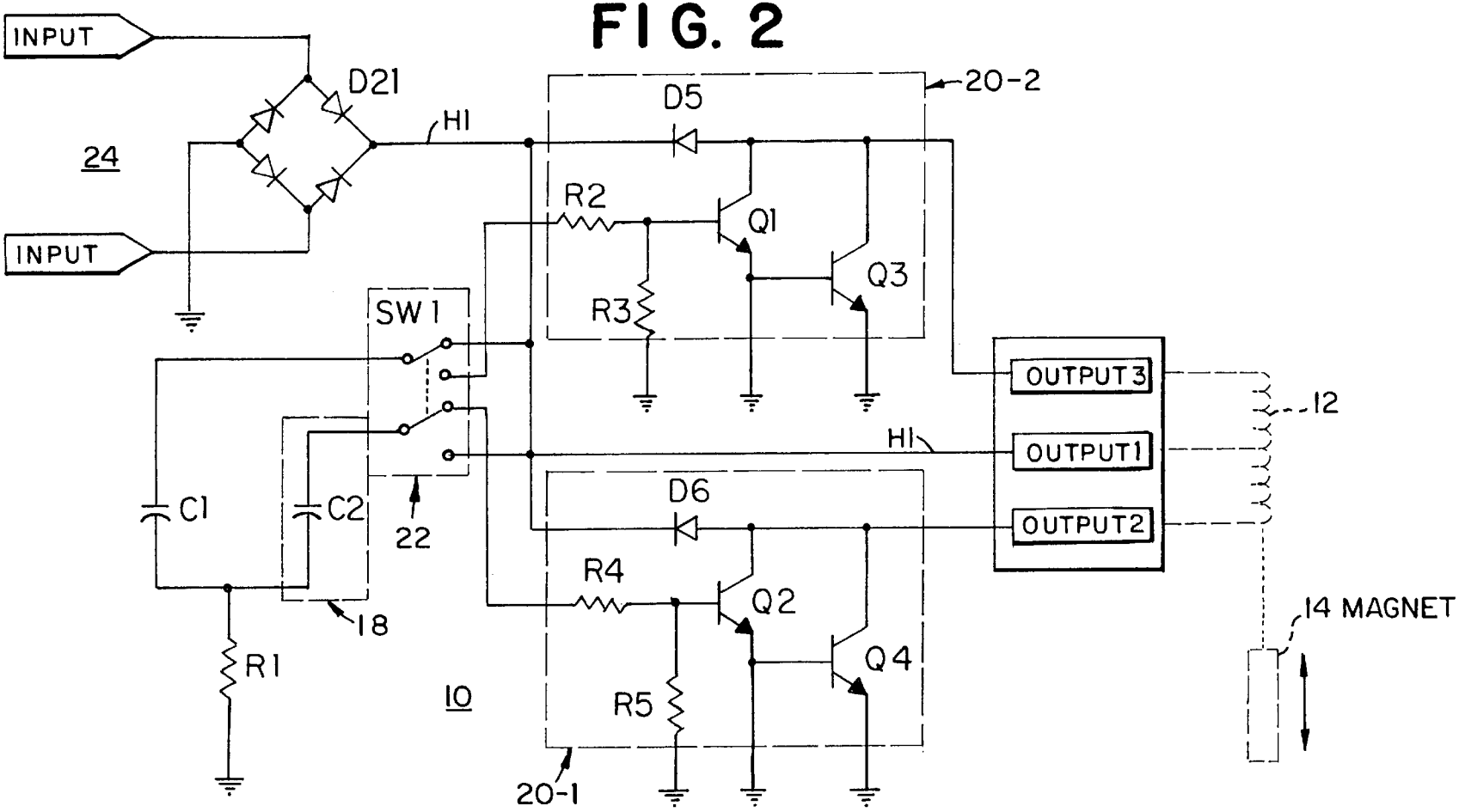
FIG. 2 is a more detailed schematic view of the controller shown in FIG. 1.

In a preferred embodiment of the present invention, the controller 10 of FIG. 1 is constructed in the form of the circuit shown in FIG. 2. In particular, and as seen, the combined timer 18 is charge-discharge timer including a resister R1 and capacitors C1, C2 such that R1 and C1 are the timer 18-2 and R1 and C2 are the timer 18-1. The relay switch 20-1 is the resistors R4, R5, the diode D6, and the transistors Q2, Q4 in a Darlington configuration; the relay switch 20-2 is the resistors R2, R3, the diode D5, and the transistors Q1, Q3 in a Darlington configuration; the voltage source 24 is an AC or DC voltage across the INPUT terminals and the full-wave diode rectifier DR1; the combined actuation switch 22 is the_pole_throw switch SW1; and the outputs O1, O2, O3 are OUTPUT1, OUTPUT2, AND OUTPUT3, respectively.

With reference to the timing diagram shown in FIG. 3, the operation of the circuit shown in FIG. 2 will now be described with reference to the resetting and actuation of the relay switch 20-1. As one skilled in the art will certainly appreciate, the corresponding resetting and actuation of the relay switch 20-2 mirrors the description with regard to relay switch 20-1 in all material respects, and therefore need not be described in corresponding detail. Moreover, it will be seen that upon being changed to the A position, SW1 resets timer 18-1 and actuates timer 18-2. Likewise, upon being changed to the B position, SW1 resets timer 18-2 and actuates timer 18-1.

Preliminarily, it is to be noted that regardless of whether the voltage across the INPUT terminals is an AC or DC voltage, the full-wave rectifier DR1 in combination with the capacitors C1, C2 of the timer 18 will rectify the voltage to a substantially DC voltage hereinafter referred to as HI. As seen, HI is always present at OUTPUT1, which corresponds to the center tap of the switching coil 12. As one skilled in the art will appreciate, the actual voltage of HI will depend on the particular switching coil 12 and switching magnet 14 employed, and therefore is not a limitation to the present invention.

As shown in FIG. 2, SW1 is in the B position, which corresponds to the actuation switch 22-1 of the first switching circuit 16-1 being in the second, actuating position and the actuation switch 22-2 of the second switching circuit 16-2 being in the first, resetting position. Prior to being in the B position, SW1 must be placed in the A position (not shown) for a period of time $T_1$ (as seen in FIG. 3) to recharge the voltage at C2 ($V_{C2}$) to HI (i.e., reset the timer 18-1). As should be understood, the time necessary to recharge C2 is relatively short, on the order of microseconds or milliseconds.

During the period $T_1$, the free end of R4 (i.e., the input of the relay switch 20-1) is left floating and therefore is pulled down to ground by way of the resistor R5. Accordingly, the voltage at the base of transistor Q2 ($V_{BQ2}$) is substantially zero (as seen in FIG. 3), Q2 and Q4 are off, and OUTPUT2 is effectively isolated from ground such that the voltage at OUTPUT2 ($V_{OUT2}$) appears from OUTPUT1 by way of the switching coil 12 as HI (as seen in FIG. 3). As a result, the current through the switching coil 12 from OUTPUT 1 to OUTPUT2 ($I_{COIL}$) is substantially zero (as seen in FIG. 3).

Figure 3:
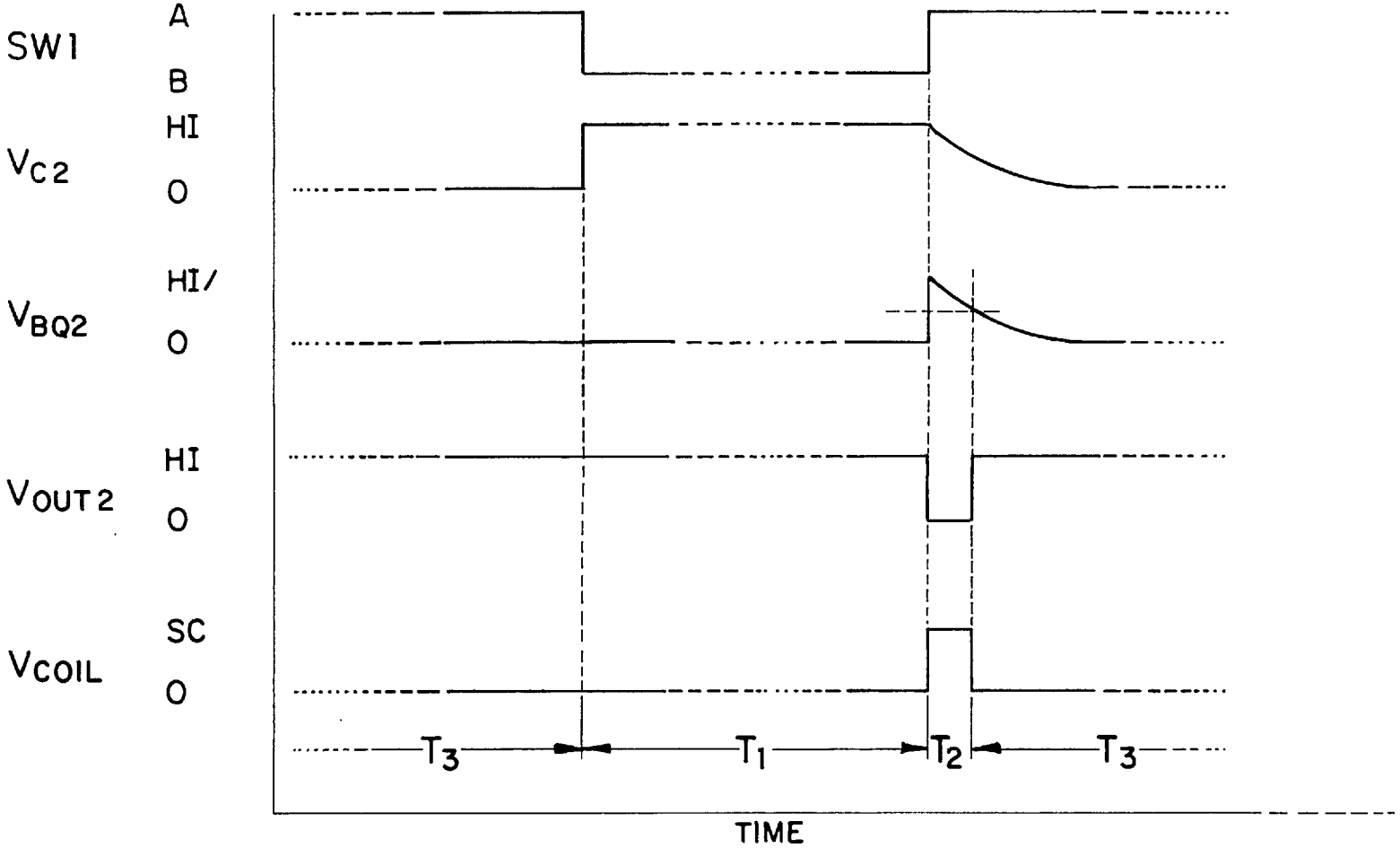
FIG. 3 is a timing diagram illustrating the operation of the controller shown in FIGS. 1 and 2.

Once SW1 is moved from the A to the B position (i.e., to actuate the timer 18-1), $T_1$ ends and the period of time $T_2$ begins (as seen in FIG. 3). As shown in FIG. 2, in the B position, C2 is connected to R4 of the relay switch 20-1. Accordingly, at the beginning of $T_2$, the HI voltage at C2 ($V_{C2}$) is resistively divided by R4, R5 and the voltage at the base of transistor Q2 ($V_{BQ2}$) is a reduced form of ($V_{C2}$). Accordingly, at the beginning of $T_2$, $V_{BQ2}$ shoots up to HI/(as seen in FIG. 3), and C2 discharges through the resistors R4 and R5 such that $V_{C2}$ and $V_{BQ2}$ exponentially drop off from HI and HI/, respectively (as seen in FIG. 3).

Preferably, R1, R4, R5, and C2 are selected such that $V_{BQ2}$ rises above a threshold voltage (as represented by the horizontal dotted line in FIG. 3) for a predetermined period of time which corresponds to $T_2$. When $V_{BQ2}$ is above the threshold voltage, Q2 and Q4 are on, and OUTPUT2 is effectively shorted to ground such that $V_{OUT2}$ is substantially zero (as seen in FIG. 3). As a result, $I_{COIL}$ is at a non-zero switching level SC (as seen in FIG. 3) during $T_2$, and the switching coil 12 moves the switching magnet 14.

As one skilled in the art will appreciate, the values of R1, R4, R5, and C2 and $T_2$ will depend on the particular switching coil 12 and switching magnet 14 employed, and therefore are not a limitation to the present invention. However, and importantly, it should be understood that in any embodiment of the present invention, $T_2$ (i.e., the time during which the switching current $I_{COIL}$ is at the non-zero SC value) should be long enough to actuate the movement of the switching magnet 14 but not so long as to burn out the switching coil. One skilled in the art will also appreciate that such values are easily calculated according to basic electrical circuit principles, and therefore need not be specified here by way of example.

Once $V_{BQ2}$ exponentially drops below the threshold voltage, $T_2$ ends and the period of time $T_3$ begins (as seen in FIG. 3). As should now be appreciated, when $V_{BQ2}$ is below the threshold voltage, Q2 and Q4 are off, and OUTPUT2 is again effectively isolated from ground such that $V_{OUT2}$ appears from OUTPUT1 by way of the switching coil 12 as HI (as seen in FIG. 3). As a result, $I_{COIL}$ is again substantially zero (as seen in FIG. 3). Importantly, $I_{COIL}$ remains at the substantially zero level until SW1 is moved back to the A position to reset the timer 18-1 (i.e., the period $T_1$) and then moved back to the B position to actuate the timer 18-1 (i.e., the period $T_2$). To prevent any unwanted voltage spikes from the switching coil 12 when Q2 and Q4 are turned off, it is preferable that the diode D6 be placed across the switching coil 12 to allow $I_{COIL}$ to bleed off harmlessly at that time.

As should now be understood, the pulse received by the switch relay, as represented by $V_{BQ2}$, has a first pulse portion at a first voltage range (i.e., during the period $T_2$), and a second pulse portion at a second voltage range (i.e., during the period $T_3$), where the second pulse portion follows the first pulse portion and continues until timer 18 is again reset and again actuated. Accordingly, the first pulse portion is defined according to the time during which $V_{BQ2}$ is above the threshold voltage and the transistors Q2 and Q4 are on. Likewise, the second pulse portion that begins at the end of the period $T_2$ and continues during the period $T_3$ is defined as the time during which $V_{BQ2}$ is below the threshold voltage and the transistors Q2 and Q4 are off. Accordingly, $V_{OUT2}$ is HI both before and after the first pulse portion, and is substantially zero during the first pulse portion (i.e., during $T_2$). Likewise, $I_{COIL}$ is substantially zero both before and after the first pulse portion, and is at the level SC during the first pulse portion.

As should also be understood, and as seen in FIG. 3, in the preferred embodiment of the present invention, the pulse defined by either timer 18-1, 18-2 and received by the relay switch 20-1, 20-2, respectively, is actually defined by both the timer 18-1, 18-2 and the actuation switch 22. In particular, for the pulse as represented by $V_{BQ2}$, the timer 18-1 defines the exponential drop portion of the pulse that begins at the beginning of $T_2$, while the actuation switch 22 defines the initial and rise portions of the pulse prior to the beginning of $T_2$. Of course, one skilled in the art will appreciate that the pulse may be defined by each timer in other ways without departing from the spirit and scope of the present invention. For example, each timer 18-1, 18-1 may instead be constructed and actuated to define the entire pulse.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A non-burnout controller for a switching coil having first and second taps, the controller comprising at least one switch circuit with:

an actuatable resetable pulse timer for being reset and for defining a pulse after being reset and actuated, the pulse having a predetermined pulse period;

a relay switch having:

a switch actuation input for receiving the pulse; and first and second switch outputs for being electrically coupled to the first and second taps of the switching coil, the relay switch placing a switching voltage across the first and second switch outputs during the pulse period, the switching coil thereby having a switching current running therethrough, the relay switch placing a substantially zero non-switching voltage across the first and second switch outputs before and after the pulse period, the switching coil thereby having substantially no switching current running therethrough; and an actuation switch positionable in first and second positions:

the actuation switch upon being changed to the first position resetting the timer, whereby the switching coil has substantially no current running therethrough; and the actuation switch upon being changed to the second position actuating the timer to define the pulse and issuing the pulse to the switch actuation input of the relay switch, whereby during the pulse period the switching coil has the switching current running therethrough, and after the pulse period the switching coil has substantially no current running therethrough, the predetermined length of the pulse period preventing switching coil burnout.

2. The controller of claim 1 wherein:

the issued pulse has a first pulse portion in a first voltage range and a second pulse portion in a second voltage range, the second pulse portion following the first pulse portion and continuing until the timer is again reset and again actuated;

the relay switch places the switching voltage across the first and second switch outputs when the switch actuation input is in the first voltage range;

the relay switch places the substantially zero non-switching voltage across the first and second switch outputs when the switch actuation input is in the second voltage range;

the actuation switch upon being changed to the first position allowing the switch actuation input of the relay switch to be in the second voltage range; and the actuation switch upon being changed to the second position actuating the timer to define the pulse and issuing the defined pulse to the switch actuation input of the relay switch such that the switch actuation input is in the first voltage range during the first pulse period and is in the second voltage range during the second pulse period of time, whereby during the first pulse period the switching coil has the switching current running therethrough, and during the second pulse period the switching coil has substantially no current running therethrough, the first pulse period having a predetermined length to prevent switching coil burnout.

3. The controller of claim 1 wherein:

the timer is a charge-discharge timer;

the actuation switch upon being changed to the first position electrically coupling a voltage source to the charge-discharge timer for charging such charge-discharge timer to a first voltage range; and the actuation switch upon being changed to the second position electrically coupling the charged charge-discharge timer to the switch actuation input of the relay switch such that the switch actuation input is in the first voltage range for a period of time until the charge-discharge timer discharges to a second voltage range.

4. The controller of claim 3 wherein the charge-discharge timer is a resistive-capacitive circuit.

5. The controller of claim 3 wherein:

the actuation switch upon being changed to the first position electrically de-coupling the switch actuation input of the relay switch such that the switch actuation input is in the second voltage range.

6. The controller of claim 1 wherein:

the first switch output is electrically coupled to a voltage source having a source voltage;

the second switch output has a substantially zero voltage during the pulse period; and the second switch output has substantially the source voltage before and after the pulse period.

7. The controller of claim 1 wherein:

the first switch output is electrically coupled to a voltage source having a source voltage;

the second switch output is substantially short circuited to a ground during the pulse period; and the second switch output is substantially open circuited to the ground before and after the pulse period.

8. The controller of claim 1 wherein the first tap of the switching coil is a center tap, the second tap of the switching coil is a first end tap, and the switching coil further comprises a third tap which is a second end tap, the controller comprising first and second of switching circuit;

the first and second switch outputs of the relay switch of the first switching circuit for being electrically coupled to the first and second taps of the switching coil, respectively;

the first and second switch outputs of the relay switch of the second switching circuit for being electrically coupled to the first and third taps of the switching coil, respectively;

the actuation switch of the first switching circuit and the actuation switch of the second switching circuit comprising a combined actuation switch positionable in A and B positions:

the combined actuation switch in the A position corresponding to the actuation switch of the first switching circuit being in the first position and the actuation switch of the second switching circuit being in the second position;

the combined actuation switch in the B position corresponding to the actuation switch of the first switching circuit being in the second position and the actuation switch of the second switching circuit being in the first position.

9. The controller of claim 8 wherein:

the timer of the first switching circuit and the timer of the second switching circuit comprise a combined charge-discharge timer having a resistive element, a first capacitive element associated with the first switching circuit, and a second capacitive element associated with the second switching circuit;

the combined actuation switch upon being changed to the A position:

electrically coupling a voltage source to the first capacitive element for charging such first capacitive element to a first voltage range; and electrically coupling the charged second capacitive element to the switch actuation input of the relay switch of the second switching circuit such that the switch actuation input of the second switching circuit is in the first voltage range for a period of time until the second capacitive element discharges to a second voltage range; and the combined actuation switch upon being changed to the B position:

electrically coupling the voltage source to the second capacitive element for charging such second capacitive element to the first voltage range; and electrically coupling the charged first capacitive element to the switch actuation input of the relay switch of the first switching circuit such that the switch actuation input of the first switching circuit is in the first voltage range for a period of time until the first capacitive element discharges to the second voltage range.

10. The controller of claim 9 wherein:

the combined actuation switch upon being changed to the A position electrically de-couples the switch actuation input of the relay switch of the first switching circuit such that the switch actuation input of the first switching circuit is in the second voltage range; and the combined actuation switch upon being changed to the B position electrically de-couples the switch actuation input of the relay switch of the second switching circuit such that the switch actuation input of the second switching circuit is in the second voltage range.

11. The controller of claim 1 further comprising the switching coil and a switching magnet associated therewith, wherein the switching coil actuates a mechanical switch by way of the switching magnet.

12. A non-burnout controller for a switching coil having first and second taps, the controller comprising:

a voltage input for receiving an input voltage having a predetermined voltage level;

a first output electrically coupled to the voltage input for receiving the input voltage, the first output for being electrically coupled to the first tap of the switching coil;

a charge-discharge timer;

a relay switch having:

a switch voltage input electrically coupled to the voltage input for receiving the input voltage;

a switch actuation input; and a switch output having an output voltage, the output voltage being substantially zero when the switch actuation input is in a first voltage range and being substantially the input voltage when the switch actuation input is in a second voltage range;

a second output electrically coupled to the switch output for receiving the output voltage, the second output for being electrically coupled to the second tap of the switching coil, the switching coil having a switching current running therethrough when the output voltage at the second output is substantially zero, the switching coil having substantially no current running therethrough when the output voltage at the second output is substantially the input voltage;

an actuation switch movable between first and second positions:

the switch in the first position:

electrically coupling the voltage input to the charge-discharge timer for charging such charge-discharge timer to the first voltage range; and electrically de-coupling the switch actuation input of the relay switch such that the switch actuation input is in the second voltage range, whereby the output voltage of the relay switch is substantially the input voltage and the switching coil has substantially no current running therethrough; and the switch in the second position:

electrically coupling the charged charge-discharge timer to the switch actuation input of the relay switch such that the switch actuation input is in the first voltage range for a period of time until the charge-discharge timer discharges to the second voltage range, whereby during the period of time the output voltage of the relay switch is substantially zero and the switching coil has the switching current running therethrough, and after the period of time the output voltage of the relay switch is substantially the input voltage and the switching coil has substantially no current running therethrough, the period of time having a predetermined length to prevent switching coil burnout.

* * * * *